US007028366B2

(12) United States Patent
Brozoska

(10) Patent No.: US 7,028,366 B2
(45) Date of Patent: Apr. 18, 2006

(54) ANGULAR NOTCHED TROWEL

(76) Inventor: Allen R. Brozoska, 2520 Pembrook Point, Champaign, IL (US) 61821

( * ) Notice: Subject to any disclaimer, the term of this patent is extended or adjusted under 35 U.S.C. 154(b) by 309 days.

(21) Appl. No.: 10/658,955

(22) Filed: Sep. 10, 2003

(65) Prior Publication Data

US 2005/0053723 A1 Mar. 10, 2005

(51) Int. Cl.
*B05C 17/10* (2006.01)

(52) U.S. Cl. ..... 15/245.1; 15/236.08; 15/235.4; 15/235.6; D8/45; D32/46

(58) Field of Classification Search ..... 15/105.5, 15/236.05–236.08, 235.8, 235.6, 235.4, 245.1; D8/45; D32/46
See application file for complete search history.

(56) References Cited

U.S. PATENT DOCUMENTS 397,129 A 2/1889 Hill
1,008,382 A * 11/1911 Sourek ..... 15/197
3,366,987 A * 2/1968 Giustino ..... 15/105
3,611,470 A * 10/1971 Gaston ..... 15/235.6
4,080,684 A 3/1978 Venditti ..... 15/104
4,804,321 A 2/1989 Riesgo ..... 425/87
6,243,906 B1 * 6/2001 Holliday et al. ..... 15/111

* cited by examiner

*Primary Examiner*—Mark Spisich
*Assistant Examiner*—Shay L. Balsis
(74) *Attorney, Agent, or Firm*—Philip L. Bateman

(57) ABSTRACT

An angular notched trowel applies a bonding material uniformly to a substrate. The angular notched trowel contains: (a) a top plate; (b) a notched plate connected along and descending from the trailing edge of the top plate; (c) a handle connected to the upper surface of the top plate, and (d) a descending member connected to the lower surface of the top plate or the handle. The bottom of the descending member is located so that the spread section is substantially free of gaps.

3 Claims, 3 Drawing Sheets

40
20
30
50

40
30
50
20

10
40
20
30

40
50
20
30

30
20
50
40

50
10"
40
20
30

ANGULAR NOTCHED TROWEL

FIELD OF THE INVENTION

This invention relates to hand tools. More particularly, this invention relates to notched trowels of the type that are used to apply a bonding material to a substrate.

BACKGROUND OF THE INVENTION

Tiles made of ceramic, stone, plastic, or the like have been affixed to floors, walls, tables, countertops, and other surfaces since antiquity. The surface upon which the tile is installed is commonly referred to as the substrate. During installation of tile, the substrate is first covered with a spreadable bonding material such as mortar, cement, epoxy, adhesive, or the like. The tile is then pressed against the bonding material to form the bond.

The application of the bonding material to the substrate is one of the most important parts of tile installation. For optimal results, each tile must be applied so that 100 percent of its surface contacts the bonding material. Gaps cause the tile to break, crack, and separate from the substrate. To achieve optimal contact, the bonding material must be applied completely, evenly, and to the desired thickness. In practice, it is very difficult to apply the bonding material precisely and, as a result, the tiles rarely make 100 percent contact with the bonding material, especially as the size of the tile increases. For example, the American National Standards Institute (ANSI) recognizes the difficulty of achieving 100 percent contact and only recommends an average uniform contact area of 80 percent.

The bonding material is typically applied to the substrate using a two-step method. The first step is to liberally apply the bonding material to the substrate with a trowel or other tool. The second step is to remove excess material with a flat notched trowel containing a series of uniform square or curved notches along an edge. When the notched trowel is used, the notched edge of the trowel is pressed against the substrate and moved across the surface as the trailing edge. Rows of bonding material remain on the substrate after the notched trowel has been moved across it. The angle which the notched trowel makes to the substrate affects the amount of bonding material remaining on the substrate. The maximum amount is left when the notched edge is perpendicular to the substrate and the amount decreases as the angle made by the notched edge to the substrate decreases.

To achieve greater uniformity in applying the bonding material, a variety of applicators have been disclosed which fix the angle made by the notched edge to the substrate. Hill, U.S. Pat. No. 397,129, issued Feb. 5, 1889, discloses a flat trowel containing two trapezoidal end guides that fix the angle the trowel makes to the substrate and also fix the gap between the trailing edge and the substrate. Venditti, U.S. Pat. No. 4,080,684, issued Mar. 28, 1978, is similar to Hill except that the trapezoidal end guides are adjustable so that the angle and the gap can be changed. Riesgo, U.S. Pat. No. 4,804,321, issued Feb. 14, 1989, discloses a spreader tool having a three-sided frame and a trailing notched edge. These three applicators suffer from one common disadvantage—they all have side members that drag across the substrate and create gaps in the bonding material.

Accordingly, there is a demand for an angular notched trowel that maintains a constant angle between the notched edge and the substrate and that eliminates gaps at the sides of the trowel.

SUMMARY OF THE INVENTION

The general object of this invention is to provide an improved trowel. A more particular object is to provide an angular notched trowel that maintains a constant angle between the notched edge and the substrate and that eliminates gaps at the sides of the trowel.

I have invented an angular notched trowel for applying a bonding material to a substrate. The angular notched trowel comprises: (a) a top plate having a leading edge, a trailing edge, an upper surface, and a lower surface; (b) a notched plate having a top edge, a bottom edge, and two sides, the top edge being connected along and descending from the trailing edge of the top plate, the bottom edge containing a plurality of notches, the two sides defining a width, such that during use the bottom edge is dragged across the substrate with the width of the notched plate defining a contacting section on the substrate in front of the notched plate and also defining a spread section on the substrate behind the notched plate; (c) a handle connected to the upper surface of the top plate; and (d) a descending member having a top and a bottom, the top of the descending member being connected to the lower surface of the top plate or to the handle, the bottom of the descending member being centrally located below the top plate, such that during use the bottom of the descending member is in the contacting section so that the spread section is substantially free of gaps. I have also invented a method for uniformly applying bonding material to a substrate using the angular notched trowel.

The angular notched trowel of this invention is a significant improvement over other notched trowels because it maintains a constant angle between the notched edge and the substrate while eliminating gaps at the sides of the trowel.

DETAILED DESCRIPTION OF THE INVENTION

Figures 1, 2, 3:
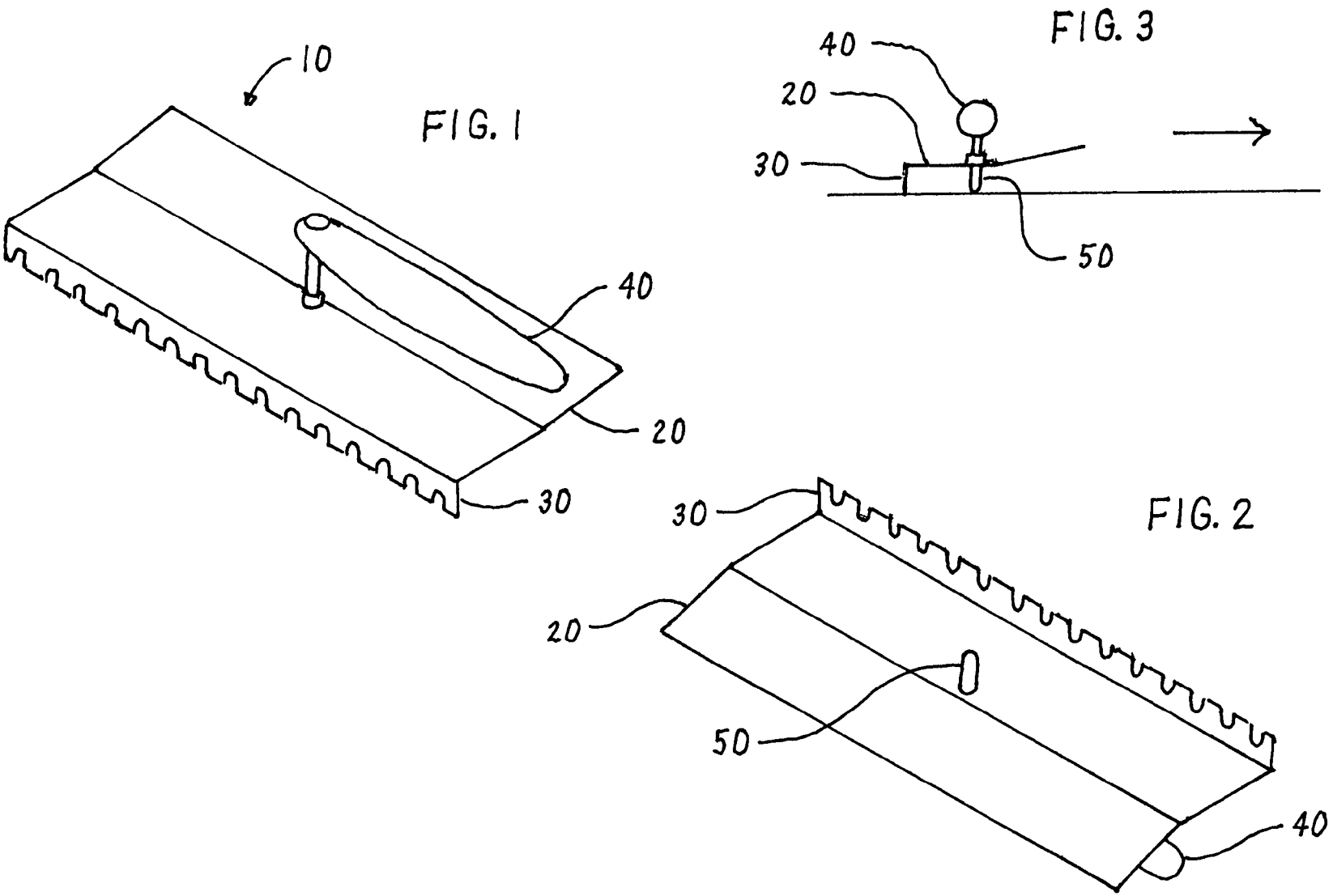
FIG. 1 is a top perspective view of a first embodiment of the angular notched trowel of this invention.
FIG. 2 is a bottom perspective view thereof.
FIG. 3 is a side elevation view thereof.

This invention is best understood by reference to the drawings. Referring first to FIGS. 1 to 3, a first embodiment of the angular notched trowel 10 of this invention is shown. The angular notched trowel contains a top plate 20, a notched plate 30, a handle 40, and a descending member 50. The components of the notched trowel are discussed in detail below.

The top plate 20 is a thin, rectangular sheet having dimensions of about eight to sixteen inches by about three to six inches. The dimensions are preferably about twelve by four inches. The sheet is made of a rigid or semi-rigid material such as metal or plastic. The preferred materials are stainless steel and galvanized steel because of their strength and freedom from rust. The top plate generally contains a leading edge that is angled slightly upwards to accommodate extra thick sections of bonding material on the substrate.

The notched plate 30 is connected along and descends from the trailing edge of the top plate. The notched plate generally makes an interior angle of about 90 to 135 degrees to the top plate. As seen best in FIG. 3, this angle is 90 degrees in the first embodiment. The notched plate generally has a height of about one-half to two inches. The bottom edge of the notched plate contains a plurality of notches that are generally substantially uniform. The size and the pattern of the notches are matters of choice and affect the amount of bonding material left on the substrate. The notches are generally semi-circular, as shown, or square.

The handle 40 is connected to the upper surface of the top plate with a post, such as a threaded bolt that passes through an opening in the distal end of the handle and is tightened with a nut. When the nut is loosened, the handle may be rotated about the bolt to the desired position. The handle is generally made of metal, wood, plastic, or the like.

The descending member 50 is connected to the lower surface of the top plate. In the embodiment shown, the descending member is an extension of the post that attaches to the handle. The bottom of the descending member and the bottom edge of the notched plate define a plane and thus form a stable surface when the notched trowel is placed onto a flat substrate. The descending member generally has a length about the same as the height of the notched plate. As best seen in FIG. 3, the descending member makes it very easy for the user to maintain the notched plate of the trowel at a constant angle relative to the substrate as the trowel is moved in the direction indicated by the arrow. This, in turn, makes it easy to leave a constant mass of bonding material to the substrate.

The descending member is connected to the lower surface of the top plate at a central point. The term "central" means a location other than along the sides so that during use the bottom of the descending member is located in the contacting section—the rectangle defined by the forward movement of the width of the notched plate. During use of the angular notched trowel, it can be appreciated that the descending member rubs along the substrate and creates a gap in the contacting section of the bonding material. As the notched plate passes over the gap, bonding material fills in and completely eliminates the gap. The spread section left behind is thus completely uniform. If the bottom of the descending member were located at the sides, a gap would be left in the spread section. In the embodiment shown, the descending member is connected to the lower surface of the top plate directly below the handle. It can also be appreciated that the width of the descending member is small enough that the gap it creates is completely filled in as the notched plate passes. The width of the descending member is generally less than about one-half inch and preferably less than about one-fourth inch. The bottom of the descending member is preferably rounded to pass more smoothly over the substrate.

It can also be appreciated that the interior angle the notched plate makes to the substrate is determined by the height of the notched plate, the length of the descending member, and the angle made by the notched plate to the top plate. Generally, the interior angle the notched plate makes to the substrate is about 45 to 90 degrees. If the interior angle is greater than about 90 degrees, there is a greater possibility of the notched plate getting caught on nail heads or other imperfections in the substrate.

Figures 4, 5, 6:
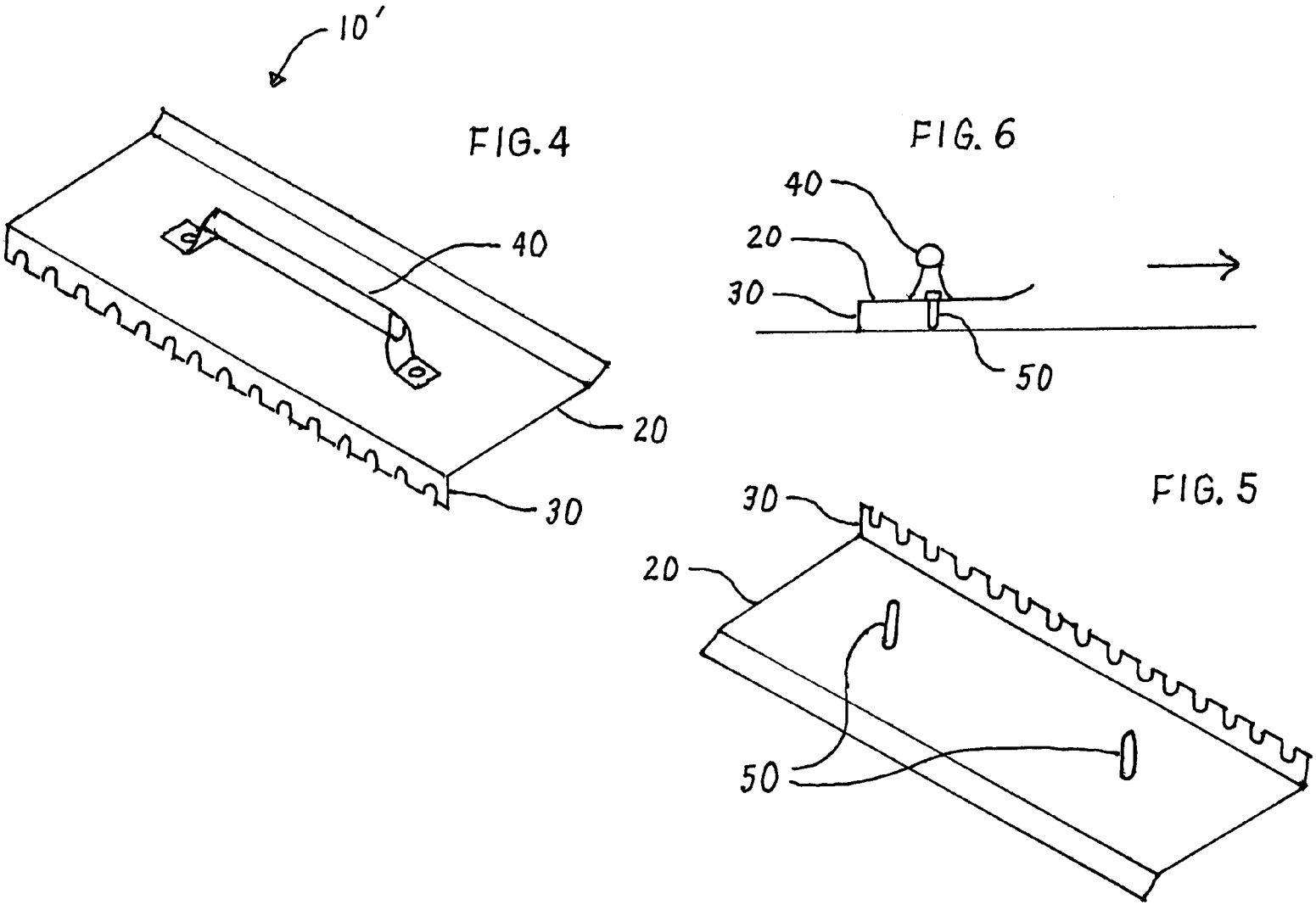
FIG. 4 is a top perspective view of a second embodiment of the angular notched trowel of this invention.
FIG. 5 is a bottom perspective view thereof.
FIG. 6 is a side elevation view thereof.
Figures 7, 8, 9:
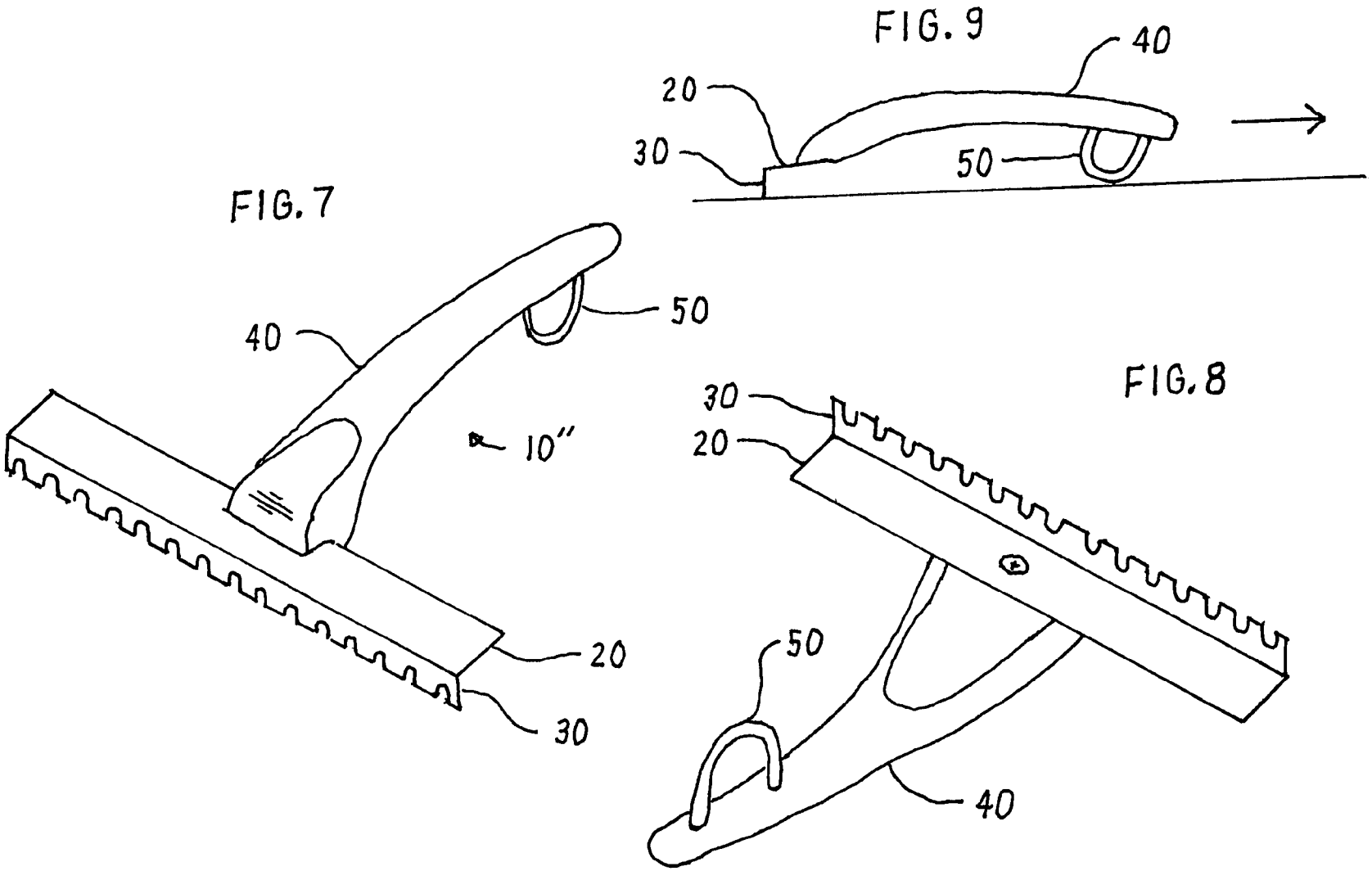
FIG. 7 is a top perspective view of a third embodiment of the angular notched trowel of this invention.
FIG. 8 is a bottom perspective view thereof.
FIG. 9 is a side elevation view thereof.

A second embodiment 10' of the angular notched trowel of this invention is shown in FIGS. 4 to 6. The second embodiment is similar to the first embodiment except that the handle is attached to the top plate at two points and there are two descending members.

A third embodiment 10" of the angular notched trowel of this invention is shown in FIGS. 7 to 10. This embodiment differs from the first and second embodiments in that the handle extends perpendicularly to the notched plate and the descending member is connected to the proximate end of the handle rather than to the top plate. The third embodiment has the general appearance of a rake, but is used in the same manner as the other two embodiments. The length of the handle and the angle it makes to the substrate during use can be varied as desired. For example, lengthening the handle to about four to six feet, angling it upwards, and locating the descending member near the distal end produces a trowel that can be used while standing.

As previously discussed, the angular notched trowel of this invention is especially useful because it maintains a constant angle between the notched edge and the substrate while eliminating gaps at the sides of the trowel. These two features result in a very uniform bed of spread bonding material on the substrate. The uniform bed, in turn, makes it possible to obtain the optimal average uniform contact area when the tiles are affixed. The angular notched trowel also has other advantages. One other advantage is that it enables the bonding material to be compressed more uniformly. Another advantage is that it can be placed with its notched plate against an abutting surface and thereby achieve a uniform bed of spread material even at corners.

I claim:

1. An angular notched trowel for uniformly applying a bonding material to a substrate, the angular notched trowel comprising:

(a) a top plate having a leading edge, a trailing edge, an upper surface, and a lower surface;

(b) a notched plate having a top edge, a bottom edge, and two sides, the top edge being connected along and descending from the trailing edge of the top plate, the notched plate forming an angle of about 90 to 135 degrees to the top plate, the bottom edge containing a plurality of notches, the top edge and the bottom edge defining a height, the two sides defining a width, such that during use the bottom edge is dragged across the substrate with the width of the notched plate defining a contacting section on the substrate in front of the notched plate and also defining a spread section on the substrate behind the notched plate;

(c) a handle connected to the upper surface of the top plate; and (d) a rigid and non-pivoting descending member having a top and a bottom, the top of the descending member being connected to the lower surface of the top plate or to the handle, the bottom of the descending member being centrally located below the top plate, the descending member having a width of less than about one-half inch and having a length about equal to the height of the notched plate such that the notched plate forms an angle to the substrate of about 45 to 90 degrees when the angular notched trowel rests on the substrate with its notched edge and the descending member in contact with the substrate, and such that during use the bottom of the descending member is in the contacting section so that the spread section is substantially free of gaps.

2. The angular notched trowel of claim 1 wherein the descending member is connected to the lower surface of the top plate directly below the handle.

3. The angular notched trowel of claim 2 wherein the bottom of the descending member is rounded.

* * * * *

UNITED STATES PATENT AND TRADEMARK OFFICE

CERTIFICATE OF CORRECTION

PATENT NO. : 7,028,366 B2
APPLICATION NO. : 10/658955
DATED : April 18, 2006
INVENTOR(S) : Brzoska It is certified that error appears in the above-identified patent and that said Letters Patent is hereby corrected as shown below:

On the title page item [12] and [76], is misspelled as "Allen R. Brozoska" should read --Allen R. Brzoska--.

Signed and Sealed this

Twenty-second Day of August, 2006

JON W. DUDAS
*Director of the United States Patent and Trademark Office*